US008511074B2

(12) United States Patent
Kuehnel et al.

(10) Patent No.: US 8,511,074 B2
(45) Date of Patent: Aug. 20, 2013

(54) HEAT TRANSFER UNIT FOR AN INTERNAL COMBUSTION ENGINE

(75) Inventors: Hans-Ulrich Kuehnel, Moenchengladbach (DE); Dieter Jelinek, Kaarst (DE); Michael Sanders, Kaarst (DE); Dieter Thoennessen, Viersen (DE)

(73) Assignee: Pierburg GmbH, Neuss (DE)

( * ) Notice: Subject to any disclaimer, the term of this patent is extended or adjusted under 35 U.S.C. 154(b) by 293 days.

(21) Appl. No.: 13/056,981

(22) PCT Filed: May 20, 2009

(86) PCT No.: PCT/EP2009/056135
§ 371 (c)(1),
(2), (4) Date: Feb. 11, 2011

(87) PCT Pub. No.: WO2010/015433

PCT Pub. Date: Feb. 11, 2010

(65) Prior Publication Data

US 2011/0290446 A1 Dec. 1, 2011

(30) Foreign Application Priority Data

Aug. 2, 2008 (DE) ..... 10 2008 036 222

(51) Int. Cl.
*F01N 3/00* (2006.01)
*F28D 7/02* (2006.01)

(52) U.S. Cl.
USPC ..... 60/298; 165/164

(58) Field of Classification Search
USPC ..... 60/298, 320, 321, 324; 123/FOR. 126; 165/51, 52, 141, 154, 164; 440/88 G, 88 J, 440/89 B, 89 C
See application file for complete search history.

(56) References Cited

U.S. PATENT DOCUMENTS

| | | | | |
|---|---|---|---|---|
| 7,347,254 | B2 * | 3/2008 | Pantow et al. | 165/179 |
| 2002/0014326 | A1 | 2/2002 | Nakado et al. | |
| 2002/0074105 | A1 * | 6/2002 | Hayashi et al. | 165/43 |
| 2003/0215679 | A1 | 11/2003 | Reinke et al. | |
| 2007/0068663 | A1 | 3/2007 | Thomer et al. | |
| 2007/0107882 | A1 | 5/2007 | Geskes et al. | |
| 2010/0025024 | A1 | 2/2010 | Meshenky et al. | |
| 2010/0139631 | A1 | 6/2010 | Geskes et al. | |

FOREIGN PATENT DOCUMENTS

| | | | |
|---|---|---|---|
| DE | 679 600 | C | 8/1939 |
| DE | 10 2004 045 923 | A1 | 5/2005 |
| DE | 20 2006 009 464 | U1 | 9/2006 |

(Continued)

*Primary Examiner* — Thomas Denion
*Assistant Examiner* — Mickey France
(74) *Attorney, Agent, or Firm* — Norman B. Thot

(57) ABSTRACT

A heat transfer unit for an internal combustion engine includes a first channel with an inlet and an outlet. The first channel is configured to have a fluid to be cooled flow therethrough. The second channel is configured to have a cooling fluid flow therethrough. A partition wall(s) is disposed to separate the first channel from the second channel. Ribs extend from partition wall(s) into the first channel and are disposed in a principal flow direction of the fluid to be cooled. The second channel comprises a first section and a second section in the principal flow direction. The ribs of the first section have a first cross section in a first flow-off portion that is constant in the principal flow direction. The ribs of the second section have a second cross section in a second flow-off portion that widens in the principal flow direction.

4 Claims, 1 Drawing Sheet

(56) References Cited

FOREIGN PATENT DOCUMENTS

| | | | | |
|---|---|---|---|---|
| DE | 10 2006 029 043 | A1 | | 12/2007 |
| EP | 661414 | A1 | * | 7/1995 |
| JP | 7091775 | A | | 4/1995 |
| JP | 8303981 | A | | 11/1996 |
| JP | 9113167 | A | | 5/1997 |
| JP | 2003 106794 | A | | 4/2003 |
| JP | 2007 85724 | A | | 4/2007 |
| WO | WO 2006/136437 | A1 | | 12/2006 |
| WO | WO 2008/091918 | A1 | | 7/2008 |

* cited by examiner

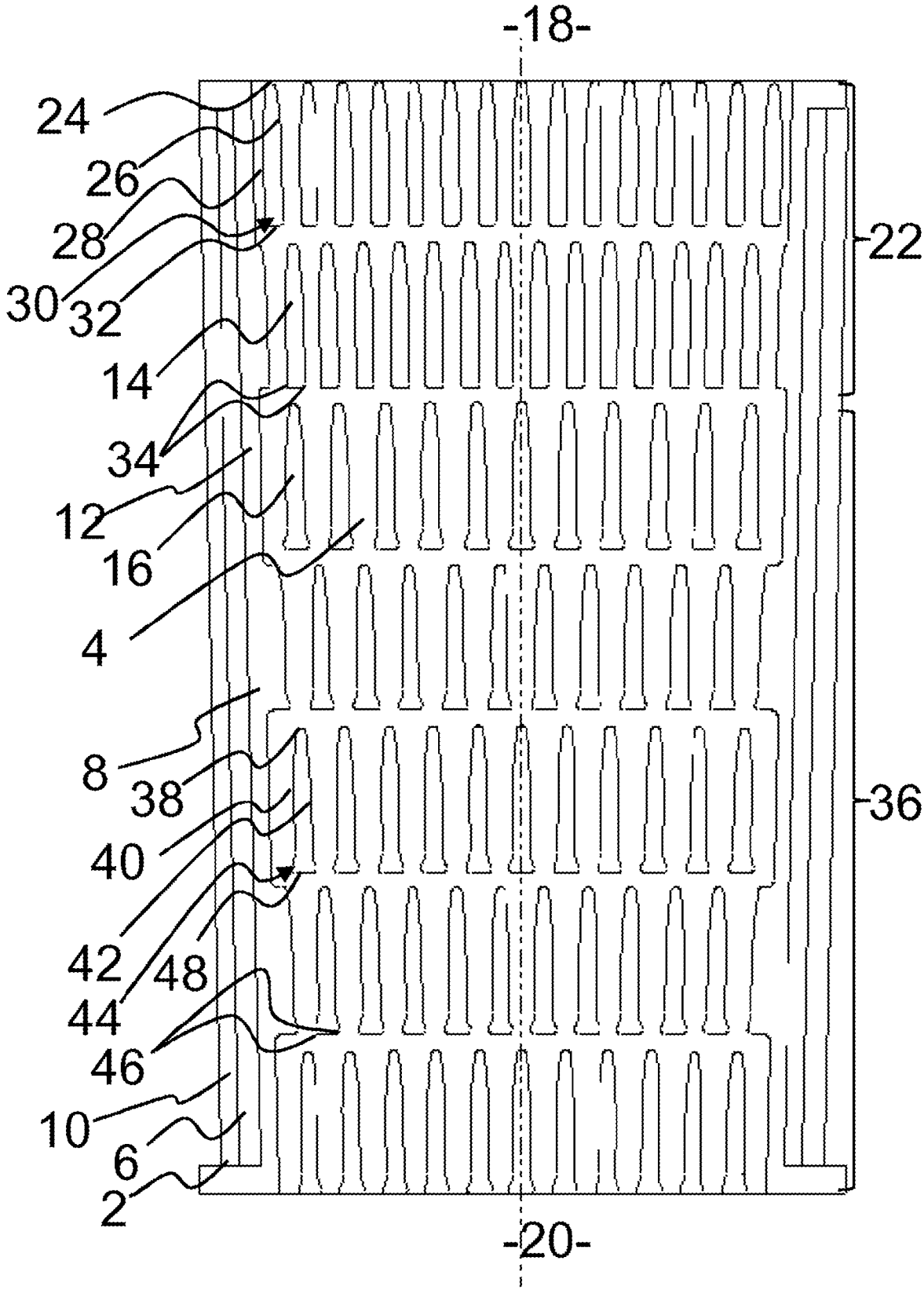
-18-
24
26
28
30
32
14
34
12
16
4
8
38
40
42
44
48
46
10
6
2
22
36
-20-

HEAT TRANSFER UNIT FOR AN INTERNAL COMBUSTION ENGINE

CROSS REFERENCE TO PRIOR APPLICATIONS

This application is a U.S National Phase application under 35 U.S.C. §371 of International Application No. PCT/EP2009/056135, filed on May 20, 2009 and which claims benefit to German Patent Application No. 10 2008 036 222.0, filed on Aug. 2, 2008. The International Application was published in German on Feb. 11, 2010 as WO 2010/015433 A1 under PCT Article 21(2).

FIELD

The present invention provides a heat transfer unit for an internal combustion engine, for example, to cool exhaust gases, comprising a channel through which a fluid to be cooled flows, the channel having an inlet and an outlet, a channel through which a cooling fluid flows, at least one partition wall separating the channel through which the fluid to be cooled flows from the channel through which the cooling fluid flows, and ribs extending from the partition wall into the channel through the fluid to be cooled flows and in the principal flow direction of the fluid to be cooled.

BACKGROUND

Heat transfer units for internal combustion engines have been described in a number of patent applications. They serve both to cool gases, such as charge air or exhaust gas, and to cool liquids, such as oil.

Not least because of the various fields of application, very different structures of heat transfer systems are known. Examples include tubular coolers, plate-like coolers and die-cast coolers.

Excess sooting of the channels through which exhaust gases flow should be prevented when cooling exhaust gases, so that the cross section of the channels should not be chosen to be too small. In order to still provide a sufficiently good heat transfer, coolers, such as coolers made by a die-cast process, have been developed in which ribs extend into the channel through which the fluid to be cooled flows, said ribs extending from the partition walls between a channel through which the cooling fluid flows and a channel through which the fluid to be cooled flows. These ribs in particular improve heat transfer with high temperature gradients.

DE 20 2006 009 464 U1 describes a heat exchanger comprising an inner and an outer shell, with the channel through which the coolant flows being formed in the inner housing of the heat exchanger, and wherein this channel is enclosed by a channel through which exhaust gas flows, into which ribs extend and which is arranged between the inner and the outer shell. Ribs extend into the channel from the partition wall between the two channels, which ribs extend over the entire length of the channel through which the fluid flows. The ribs are arranged in successive rows and each has a onflow edge joined by two side walls, the angle between the two tangents to each side wall of the ribs decreasing continuously in a front portion until the enclosed angle is 0°, and the two side walls thus extending parallel to each other in a rear portion. Both side walls end at a respective onflow edge at the end of each rib so that a right angle is formed between a rear wall of each rib and the side walls. Good heat transfer, and thus a high cooling capacity, is thereby achieved.

A heat exchanger having a rib design is also described in DE 10 2006 029 043 A1. This heat exchanger is also composed of an outer shell and an inner shell that serves as a partition wall between an inner, exhaust gas conveying channel, into which the ribs extend, and an outer, coolant conveying channel which is arranged between the inner and the outer shell. The cross section through which exhaust gas can flow is reduced over the flow path according to the reduced density of the exhaust gas in order to realize an improved cooling capacity and a lower pressure loss. Due to the higher flow velocity in the outlet region, the insulating boundary layers are reduced whereby the cooling capacity is increased. However, the reduced free cross section between the ribs result in increased sooting, particularly with colder exhaust gas, so that the efficiency of the cooler decreases.

Various rib shapes differing in width, length, height and overlap are also described in DE 10 2004 045 923 A1. These are either ribs of constant cross section or ribs with two opposite wings. These serve to improve heat transfer capability with only a slight increase in pressure loss. Heat transfer devices having one of the embodiments described above have limited efficiency, since no adjustment is made with respect to different temperature gradients and to the resulting different sooting tendencies.

SUMMARY

An aspect of the present invention is to provide a heat transfer unit, wherein the cooling capacity is at least maintained compared to known embodiments, whereas, however, sooting is reduced. A further aspect of the present invention is to provide a heat transfer unit with a lower pressure loss and an increased cooling capacity, particularly after a high number of operating hours.

In an embodiment, the present invention provides a heat transfer unit for an internal combustion engine which includes a first channel with an inlet and an outlet. The first channel is configured to have a fluid to be cooled flow therethrough. The second channel is configured to have a cooling fluid flow therethrough. A partition wall(s) is disposed to separate the first channel from the second channel. Ribs extend from partition wall(s) into the first channel and are disposed in a principal flow direction of the fluid to be cooled. The second channel comprises a first section and a second section in the principal flow direction. The ribs of the first section have a first cross section in a first flow-off portion that is constant in the principal flow direction. The ribs of the second section have a second cross section in a second flow-off portion that widens in the principal flow direction.

BRIEF DESCRIPTION OF THE DRAWINGS

The present invention is described in greater detail below on the basis of embodiments and of the drawings in which:

FIG. 1 illustrates a schematic top plan view of a heat transfer unit of the present invention.

DETAILED DESCRIPTION

The widening cross section causes an additional turbulence in the second section that primarily tends to show sooting, the increased turbulence having the effect that significantly less soot becomes adhered to the rib walls. The cooling capacity thus remains largely constant over the entire service life of the heat transfer unit. In the front portion, the pressure loss can be kept low by the ribs of constant cross section.

In an embodiment of the present invention, the longitudinal axes of the ribs in the first section can be arranged at a smaller distance from each other than in the second section. In the first section, the cooling capacity is thus increased due to the high flow velocities and the resulting thin insulating boundary layers, whereas in the second section, thicker boundary layers are dissolved by the existing turbulences. The larger spacing in this second section results in lower flow velocities, but also results in a lower pressure loss and in a reduced sooting on the walls of the ribs. The dwell time is also increased. The cooling capacity can therefore be maintained almost constant over the entire heat exchanger, and sooting reduced.

In an embodiment of the present invention, the ribs arranged in the second section can have a linear inflow edge from where two side walls extend, the angle between tangents to the side walls first decreasing constantly in the principal flow direction until the side walls are parallel to each other, whereas in the flow-off region, the angle between the tangents to the side walls again increases. Ribs of such design create strong eddies and thus strong turbulences in the second section, so that sooting is significantly reduced in the second section. At the same time, the pressure loss caused by the ribs remains rather low due to the rib sidewalls of constant design. This rib shape is also easy to manufacture even in a die-cast process and has sufficient stability. Additional fittings for causing turbulences can be omitted.

These embodiments reduce sooting in the heat transfer unit without sacrificing cooling capacity or increasing pressure loss. After a large number of operating hours, this results in an improved cooling capacity when compared to known embodiments.

One embodiment of the heat transfer unit of the present invention is illustrated in FIG. 1 and will be described hereinafter.

The heat transfer unit illustrated in FIG. 1 is formed by a housing 2, in which a channel 4, through which a fluid to be cooled flows, and a channel 6, through which a cooling fluid flows, are provided. Since a problem of excessive sooting occurs due to the soot present in exhaust gas, in particular when such a heat transfer unit is used as an exhaust gas cooler, channel 4, through which a fluid to be cooled flows, will hereinafter be referred to as the exhaust gas flow channel to facilitate understanding.

The housing 2 is composed of a multipart inner shell 8 and an outer shell 10 surrounding the inner shell 8, said outer shell being substantially spaced from the inner shell 8.

In the embodiment shown in FIG. 1, the coolant flow channel 6 is arranged between the inner shell 8 and the outer shell 10 and thus surrounds the channel 4 through which the fluid to be cooled flows, which channel is defined by the circumferential walls of the inner shell 8. The circumferential walls of the inner shell 8 thus form a partition wall 12 between the two fluids in a heat-exchange relationship. From two opposite sides, ribs 14, 16 extend from the partition wall 12 to improve the heat transfer into the exhaust gas flow channel 4, which ribs are illustrated in longitudinal section in FIG. 1.

The inner shell 8 has an inlet 18 as well as an opposite outlet 20 for the exhaust gas. The inlet and the outlet of the coolant flow channel 6 are not illustrated in FIG. 1 and may be formed, for instance, by pipe sockets in the area of the outer shell. It is also be possible to give this exhaust gas flow channel a U-shape so that the inlet 18 and the outlet 20 are arranged side by side.

Exhaust gas flowing into the heat exchange unit first flows from the inlet 18 into a first section 22 in which ribs 14 are provided comprising an onflow edge 24 and two side walls 26, 28 extending linearly from this onflow edge 24, wherein the tangents to the side walls include a continuously decreasing angle as seen in the principal flow direction of the exhaust gas, until the side walls 26, 28 extend in parallel with each other. This parallel alignment is also maintained in a flow-off portion 30 up to the end of the ribs 14. The side walls 26, 28 therefore each include an angle of about 90.degree. with an end wall 32. Two flow-off edges 34 thus exist at the end of the ribs 14 from which exhaust gas can flow further in channel 4.

Having flowed through the first section 22, which in FIG. 1 is formed by two rows of ribs 14, the exhaust gas flow reaches a second section 36 in which ribs 16 of different shape are arranged. This second section 36 is formed by five successive rows of ribs 16, the ribs 14, 16 in both the first and the second section 22, 36 being respectively offset from the ribs 14, 16 in the following row.

Like the ribs 14, the ribs 16 of the second section 36 have an onflow edge 38 and two side walls 40, 42 extending linearly from this onflow edge 38, the tangents to the side walls including an angle ever decreasing in the principal flow direction of the exhaust gas until the side walls 40, 42 are parallel to each other. Different from the ribs 14, the angle between the tangents to the side walls 40, 42 increases again in the flow-off portion 44, as seen in the flow direction. This means that in contrast with the ribs 14, the present invention provides that, as seen in the flow direction, the cross section of the ribs 16 increases in the flow-off portion 44, whereas this cross section of the ribs 14 remains constant in the flow-off portion 30. Thus, also with the ribs 16, two flow-off edges 46 are formed between the end of the side walls 40, 42 and an end wall 48 extending vertically to the principal flow direction. The angle included between a tangent to one of the side walls 40, 42 is therefore less than 90.degree. in the flow-off portion 44 and at the end wall 48.

The flow-off portion 44 is configured to deflect the exhaust gas flow in this region, while velocity is increased because of the constricted cross section, both features causing a more pronounced forming of eddies, and thus of turbulence, in the second section 36. This turbulence significantly reduces the sooting of the ribs 16 which is particularly severe in the second section of known heat exchangers. FIG. 1 also shows that the spacing between the axes extending in the principal flow direction through the ribs 14, 16 is smaller in the first section 22 than in the second section 36. This increases the flow velocity of the exhaust gas in the first section 22, whereby smaller boundary layers are formed and the degree of cooling efficiency is increased. The larger distance between the rib axes in the second section 36 can decrease the flow velocity and can thus increase the insulating boundary layers, but this is largely compensated for by the additional forming of eddies at the flow-off portions 44. The higher pressure loss at the front portion caused by the narrower gaps can also largely be compensated for by the lower pressure loss in the second section 44.

In order to achieve an almost constant free throughflow cross section in a respective section, the respective rib shapes cab be formed as rib halves on the side walls in every second row of ribs due to the mutual offset between the rows of ribs.

The present invention thus provides a heat treatment unit with which sooting can be significantly reduced, while pressure loss and cooling capacity are almost constant, whereby, in turn, the cooling capacity can essentially be maintained constant throughout the service life of the heat transfer unit.

It should be clear that the structure of the heat transfer unit could be chosen differently and that the scope of protection of this application is not limited to coolers made by die-casting. For example, it is also possible for die-cast coolers to change the flow direction in the course of the heat transfer unit. The length of the two successive sections can be optimized depending on the application. The distances between the rib axes actually used should further be optimized as a function of the size and the design of the heat transfer unit. Various other models are conceivable.

The present invention is not limited to embodiments described herein; reference should be had to the appended claims.

The invention claimed is:

1. A heat transfer unit for an internal combustion engine, the heat transfer unit comprising:

a first channel with an inlet and an outlet, the first channel being configured to have a fluid to be cooled flow therethrough;

a second channel configured to have a cooling fluid flow therethrough;

at least one partition wall disposed so as to separate the first channel from the second channel; and ribs extending from the at least one partition wall into the first channel and disposed in a principal flow direction of the fluid to be cooled;

wherein the first channel comprises a first section and a second section successive in the principal flow direction, the ribs of the first section having a first cross section in a first flow-off portion that is constant in the principal flow direction, and the ribs of the second section having a second cross section comprising a section in which two side walls extend parallel to each other before widening in a second flow-off portion in the principal flow direction.

2. The heat transfer unit as recited in claim 1, wherein a first distance between longitudinal axes of the ribs in the first section is smaller than a second distance between longitudinal axes of the ribs in the second section.

3. The heat transfer unit as recited in claim 1, wherein the ribs of the second section have a linear onflow edge disposed where two side walls extend, wherein, an angle between two tangents to the two side walls first decreases continuously in the principal flow direction until the side walls extend parallel with each other, and the angle between the tangents to the side walls increases in the second flow-off portion as in the principal flow direction.

4. Method of using a heat transfer unit to cool an exhaust gas from an internal combustion engine, the method comprising:

providing a heat transfer unit comprising:

a first channel with an inlet and an outlet, the first channel being configured to have a fluid to be cooled flow therethrough, a second channel configured to have a cooling fluid flow therethrough, at least one partition wall disposed so as to separate the first channel from the second channel, and ribs extending from the at least one partition wall into the first channel are disposed in a principal flow direction of the fluid to be cooled, wherein the first channel comprises a first section and a second section successive in the principal flow direction, the ribs of the first section having a first cross section in a first flow-off portion that is constant in the principal flow direction, and the ribs of the second section having a second cross section comprising a section in which two side walls extend parallel to each other before widening in a second flow-off portion in the principal flow direction;

providing an internal combustion engine emitting an exhaust gas; and flowing the exhaust through the heat transfer unit so as to cool the exhaust gas.

* * * * *